US008246217B2

(12) United States Patent
Fann

(10) Patent No.: US 8,246,217 B2
(45) Date of Patent: Aug. 21, 2012

(54) APPARATUS FOR ELIMINATING GHOST IMAGE OF POINT LIGHT SOURCES

(75) Inventor: Jame-Kwei Fann, Taoyuan (TW)

(73) Assignee: Leaway Precision Co., Ltd., Jhongli (TW)

( * ) Notice: Subject to any disclaimer, the term of this patent is extended or adjusted under 35 U.S.C. 154(b) by 446 days.

(21) Appl. No.: 12/572,273

(22) Filed: Oct. 2, 2009

(65) Prior Publication Data

US 2010/0238659 A1 Sep. 23, 2010

(30) Foreign Application Priority Data

Mar. 18, 2009 (TW) ..... 98108767 A

(51) Int. Cl.
*F21V 5/00* (2006.01)

(52) U.S. Cl. ..... 362/311.02; 362/227; 362/235; 362/244; 362/249.02; 362/311.06

(58) Field of Classification Search ..... 362/227, 362/234–235, 237, 240, 244–246, 249.02, 362/311.01–311.02, 311.06–311.07, 800
See application file for complete search history.

(56) References Cited

U.S. PATENT DOCUMENTS

2008/0030835 A1* 2/2008 Tonar et al. ..... 359/267
2008/0049430 A1* 2/2008 Sakumoto ..... 362/296
2010/0012957 A1* 1/2010 Lin et al. ..... 257/98

* cited by examiner

*Primary Examiner* — Stephen F Husar
*Assistant Examiner* — Meghan Dunwiddie
(74) *Attorney, Agent, or Firm* — Lin & Associates IP, Inc.

(57) ABSTRACT

An apparatus adapted for eliminating a ghost image of point light sources is disclosed. The apparatus includes a plurality of point light sources adjacently arranged, and a plurality of medium elements provided corresponding to the point light sources. Each of the point light sources is adapted for emitting a light. Each of the medium elements includes a light input surface, and a light output surface, and both of the light input surface and the output surface are arcuate surfaces adapted for diffusing the light emitted from the point light source. The point light source emits the light, and the light is inputted from the light input surface of the medium element and outputted from the light output surface of the medium element, thus configuring a uniformly distributed light without producing a ghost image. Further, a fluorescent material may be mixed in the medium element for obtaining a color combined light.

19 Claims, 7 Drawing Sheets

APPARATUS FOR ELIMINATING GHOST IMAGE OF POINT LIGHT SOURCES

BACKGROUND OF THE INVENTION

1. Field of the Invention

The present invention relates generally to an illumination apparatus, and more particularly, to an apparatus for eliminating a ghost image generated by adjacently arranged point light sources.

2. The Prior Arts

Light emitting diodes (LED), facilitated by the improvement of related technologies, now have the advantages of lower power consumption, and longer lifespan, and thus have been widely used for illumination applications. LEDs are usually featured with a very small size. Therefore, the luminance offered by a single piece of LED is typically not comparable with an ordinary incandescent lamp, fluorescent lamp, or other conventional lamps. As such, an LED lamp used for illumination purpose is usually constituted of a plurality of LEDs. In such a way, the luminance provided by all of the LEDs can be gathered and concentrated for obtaining an applicable luminance.

When a plurality of LEDs are arranged in a certain area, the overall luminance obtained thereby can be equivalent to that of an ordinary lamp. However, an LED is substantially considered as a point light source, in which the center of the LED has the greatest luminance. In other words, the luminance of the LED is excessively concentrated. As such, when two or more such LEDs are adjacently distributed and concurrently used, a superimposed shadow which is also known as a ghost image often occurs. Working under such an illumination environment, eyes are likely to feel uncomfortable, or even dizzy.

SUMMARY OF THE INVENTION

The present invention is featured in providing a medium element to a point light source, such as an LED. The medium element includes a light input surface and a light output surface. The light input surface is adapted for diffusing a light incident thereon. The point light source emits a light, and the light is incident on the light input surface, and outputted from the light output surface. In such a way, the light emitted by the point light source is diffused into a uniformly distributed light. Therefore, the ghost image that occurs when multiple point light sources are adjacently arranged can be eliminated.

According to an embodiment of the present invention, a fluorescent material is selectively provided in the medium element in accordance with the color of the light emitted from the point light source, so as to project a desired color combined light.

According to a further embodiment of the present invention, two or more medium elements are employed for combination, in which one of the medium elements is provided with a fluorescent material.

According to an aspect of the embodiment, the medium element is a lens. The lens is hollow tube shaped. The inner surface of the hollow tube shaped lens serves as the light input surface, and the outer surface of the hollow tube shaped lens serves as the light output surface. The light input surface and the light output surface can be a paraboloidal surface, a spherical surface, or an aspherical surface.

According to another aspect of the embodiment, the lens is column shaped. One end of the column shaped lens serves as the light input surface, and an annular outer peripheral side surface of the column shaped lens serves as the light output surface. The light input surface and the light output surface can be a paraboloidal surface, a spherical surface, or an aspherical surface. The column shaped lens is further provided with a lampshade accommodating the column shaped lens therein.

For further improving the luminance of the light passing through the medium element, the present invention further includes an optical structure disposed at the light input surface and/or the light output surface. The optical structure for example includes a plurality of fine protrusive dots, or a plurality of fine recessive dots.

For obtaining an illumination proximate natural light, a fluorescent material can be provided in the medium element or the lampshade. The fluorescent material is selected in accordance with the color of the light emitted from the point light source, and therefore a light combining colors of the light emitted from the point light source and the fluorescent material is obtained.

According to an embodiment of the present invention, two medium elements are employed in combination. The light input surface of the first medium element is a plane surface, and the light output surface of the first medium element is an arcuate surface. The light input surface and the light output surface of the second medium elements are all plane surfaces. The light output surface of the second medium element is adjacent to or in contact with the light input surface of the first medium element. Or alternatively, the light input surface of the second medium element is adjacent to or in contact with the light output surface of the first medium element. The light emitted from the point light source is inputted from the light input surface of the first medium element or the second medium element, and outputted from the second medium element or the first medium element. In such a way, the ghost image can be eliminated. Further, the second medium element can be provided with a fluorescent material for obtaining a desired color combined light.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
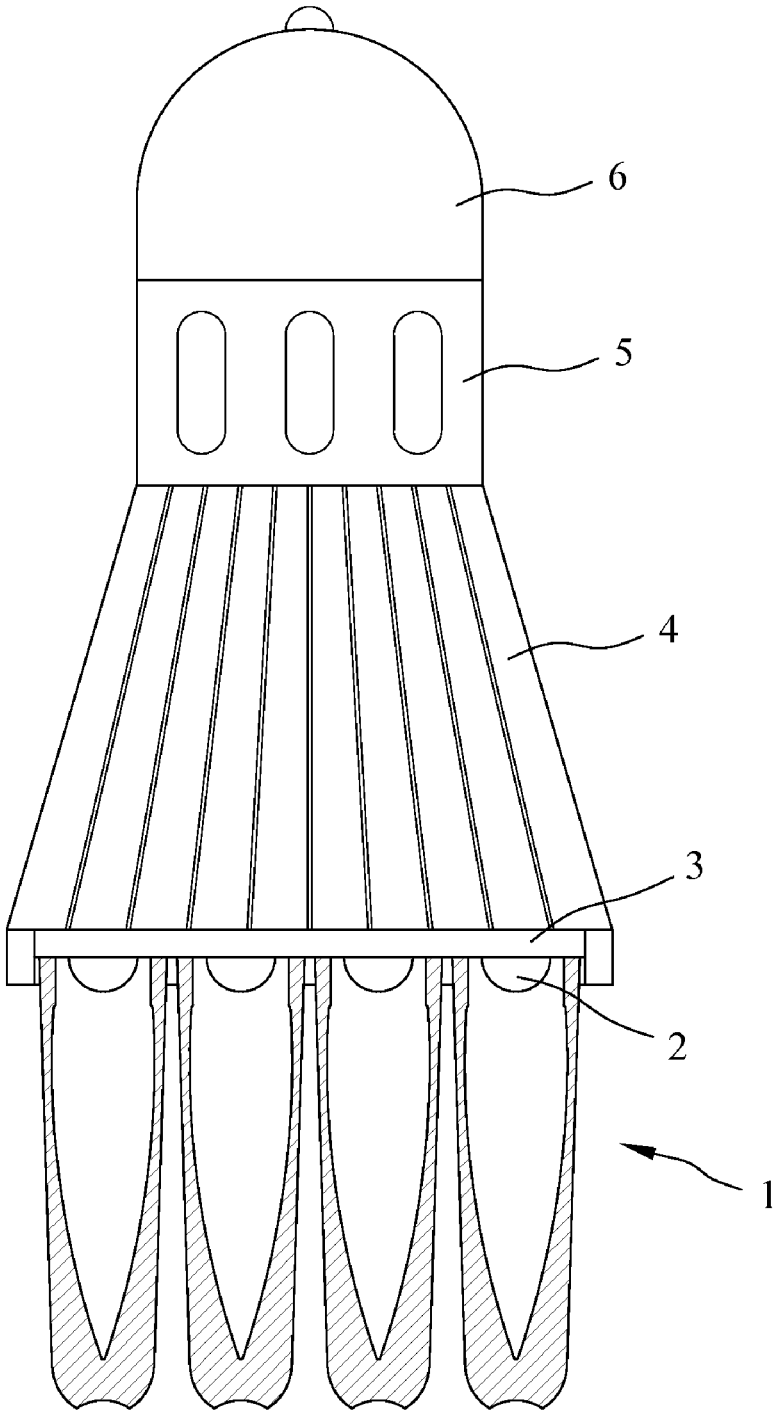
FIG. 1 is a perspective view of an apparatus for eliminating a ghost image generated by adjacently arranged point light sources according to an embodiment of the present invention.
Figure 2:
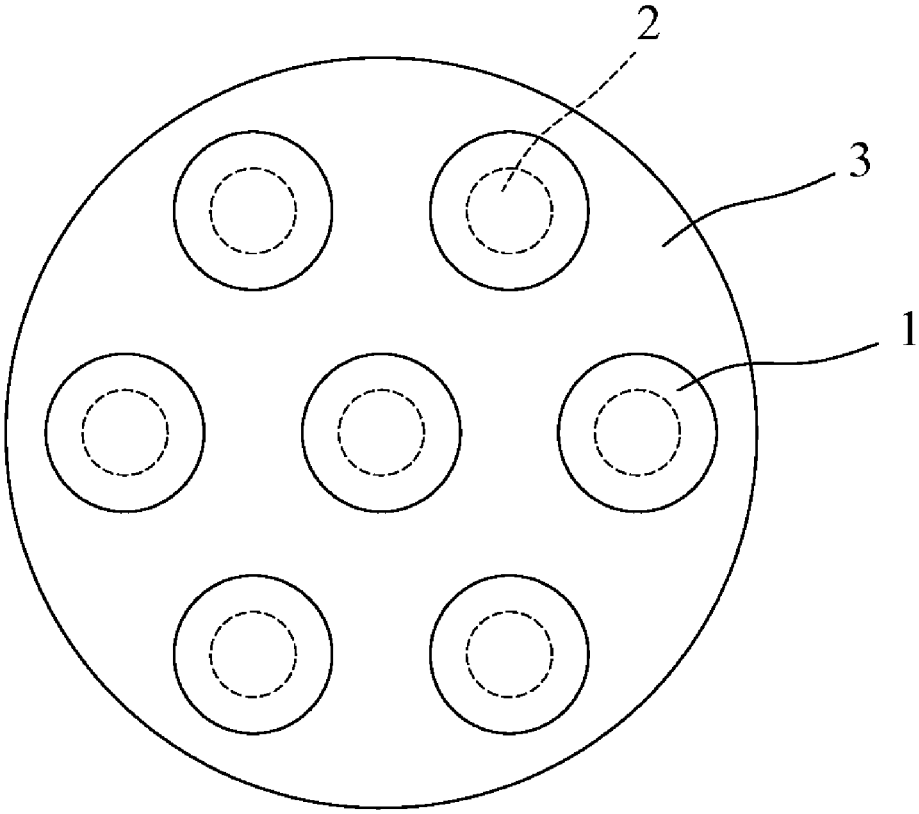
FIG. 2 is a bottom view of FIG. 1.

FIG. 1 is a perspective view of an apparatus for eliminating a ghost image generated by adjacently arranged point light sources according to an embodiment of the present invention. FIG. 2 is a bottom view of FIG. 1. Referring to FIGS. 1 and 2, the apparatus is adapted for being provided to an illuminating device which employs point light sources, e.g., LEDs. The apparatus includes a base 4, a light source socket 3. The base 4 includes a plurality of heat dissipation fins assembled thereto. The light source socket 3 is disposed on the base 4. The light source docket 3 includes a plurality of point light sources 2 embedded therein. In the current embodiment, the point light sources 2 are preferably LEDs. Each of the point light sources 2 is sheathed over with a medium element. In the current embodiment, the medium element is a lens 1. Further, the base 4 further includes a circuit board and a driver (not shown in the drawings) for driving the point light sources 2. The apparatus further includes a lamp head holder 5 disposed behind the base 4, and a lamp head 6 disposed thereafter. When the lamp head 6 is coupled to the power supply and is provided with electric power, the point light sources 2 emit a light, and the light is then projected out from the lenses 1.

Figure 3:
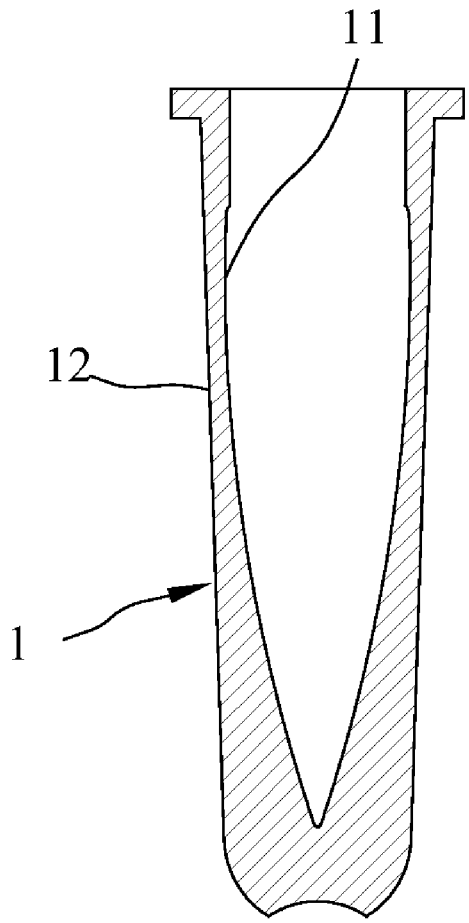
FIG. 3 is a cross-sectional view illustrating a lens according to a first embodiment of the present invention.

FIG. 3 is a cross-sectional view illustrating a lens according to a first embodiment of the present invention. Referring to FIG. 3, there is shown a lens 1. The lens 1 is configured with a hollow tube shape. The hollow tube shape of the lens 1 has an inner surface and an outer surface. The inner surface of the hollow tube shape serves as a light input surface 11 of the lens 1, and the outer surface of the hollow tube shape serves as a light output surface 12 of the lens 1. As shown in FIG. 3, both of the light input surface 11 and the light output surface 12 are arcuate surfaces adapted for diffusing the light incident thereon. Each of the arcuate surfaces for example can be a paraboloidal surface, a spherical surface, or an aspherical surface. Further, for improving the luminance of the outputted light, the light input surface 11 and/or the light output surface 12 can be disposed with an optical structure. The optical structure for example includes a plurality of fine protrusive dots or a plurality of recessive dots configured by sandblasting, etching, mechanical or laser processing. The point light sources 2 are sheathed in the lenses 1. The light emitted from the point light source 2 is inputted in the lens 1 from the light input surface 11, and outputted from the light output surface 12, during which the light is diffused and scattered and thus becomes more uniform and softer than before. Therefore, when the point light sources are adjacently arranged as shown in FIG. 1, the apparatus according to the present invention can be used for eliminating the ghost image.

Figure 4:
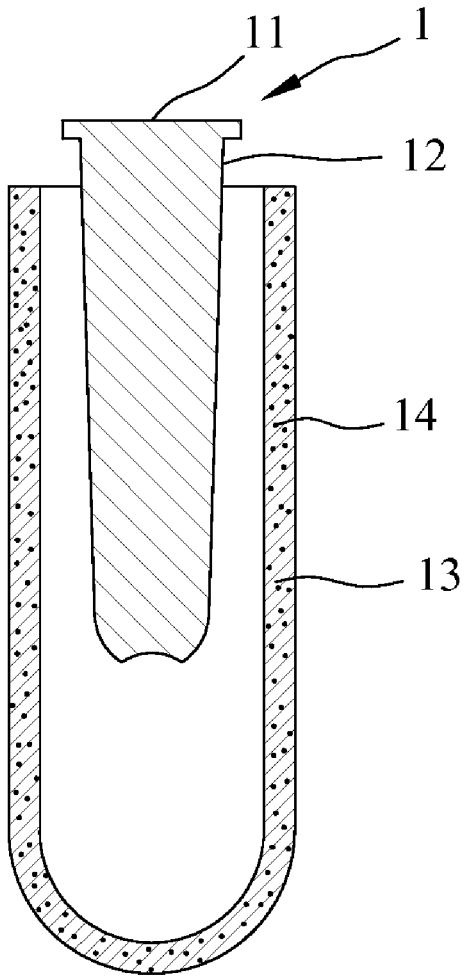
FIG. 4 is a cross-sectional view illustrating a lens according to a second embodiment of the present invention.

FIG. 4 is a cross-sectional view illustrating a lens according to a second embodiment of the present invention. Referring to FIG. 4, the lens 1 according to the second embodiment is configured with a column shape. A longitudinal end of the column shaped lens 1 serves as the light input surface 11, and an annular outer peripheral side surface of the column shaped lens 1 serves as the light output surface 12. Similarly, as shown in FIG. 4, both of the light input surface 11 and the light output surface 12 are arcuate surfaces adapted for diffusing the light incident thereon. Each of the arcuate surfaces for example can be a paraboloidal surface, a spherical surface, or an aspherical surface. Further, for improving the luminance of the outputted light, the light input surface 11 and/or the light output surface 12 can be disposed with an optical structure as discussed in the first embodiment above. The column shaped lens 1 is sheathed in a lampshade 13, and the column shaped lens 1 and the lampshade 13 as a whole are provided for receiving the point light source 2 therein. The light emitted from the point light source 2 is inputted in the lens 1 from the light input surface 11 of the column shaped lens 1, and outputted from the light output surface 12, and then dispersed from the lampshade 13. Similarly, the light can also be diffused and scattered and thus become more uniform and softer than before. Further, the lampshade 13 may include a certain quantity of fluorescent material doped therein. The fluorescent material is selected in accordance with the color of the light desired to obtain.

Figure 5:
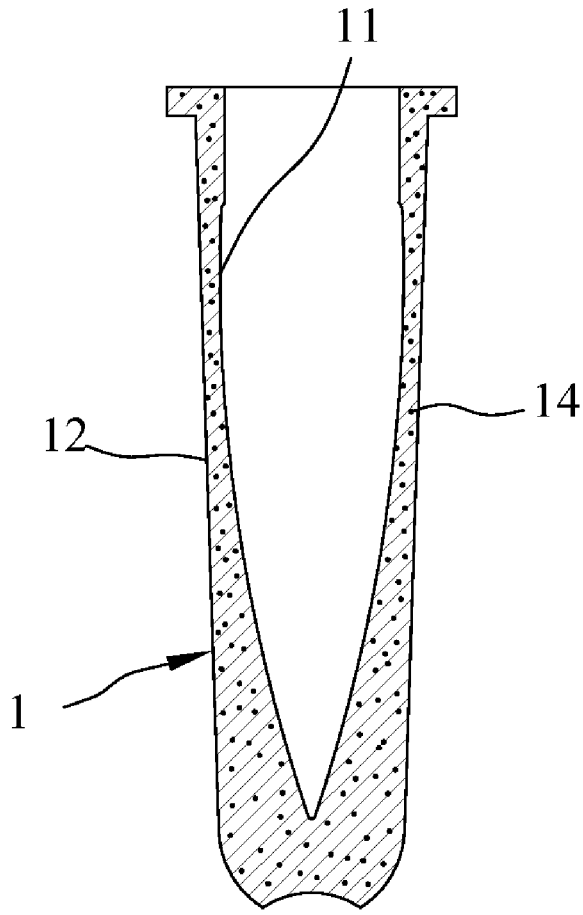
FIG. 5 depicts a fluorescent material doped in the lens according an embodiment of the present invention.

Furthermore, the three primary colors include red, green and blue colors. However, the white light emitted from the conventional white light LED is often too sharp and thus featured with a poor color rendering index. As such, in order to obtain a more natural white light, according to an aspect of the embodiment, a fluorescent material 14 of a desired color is added in the lens 1, as shown in FIG. 5. In such a way, the light emitted from the point light sources 2 is finally mixed with a light obtained by exiting the fluorescent material 14, thus obtaining a color combined light with an optimal color rendering index, which is more proximate to the natural white light. For example, when the point light sources 2 are blue light sources, yellow, green or red fluorescent materials can be added in the lenses 1, and therefore the finally obtained color combined light will be more proximate to the natural white light. Of course, the content of the fluorescent material 14 added in the lenses 1 can be adaptively adjusted for producing different color light.

Figure 6:
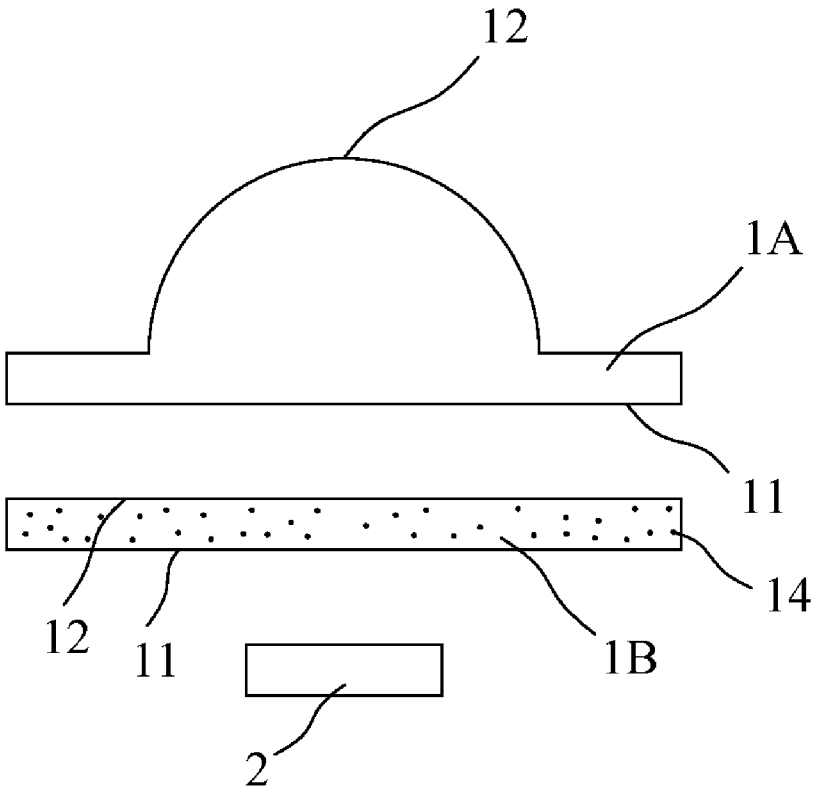
FIG. 6 is a schematic diagram illustrating two lenses employed serving as the medium elements according to an embodiment of the present invention.

FIG. 6 is a schematic diagram illustrating two lenses employed serving as the medium elements according to an embodiment of the present invention. Referring to FIG. 6, in this embodiment, a first lens 1A and a second lens 1B are employed for substituting the lens 1 and being provided for each of the point light sources 2. As shown in FIG. 6, the first lens 1A includes a light input surface 11 and a light output surface 1B, and the second lens 1B also includes a light input surface 11 and a light output surface 1B. The first lens 1A and the second lens 1B are collimated with the point light source 2. The light input surface 11 of the first lens 1A is configured with a plane surface, and the light output surface 12 of the first lens 1A is configured with an arcuate surface. The light input surface 11 of the second lens 1B is configured with a plane surface, and the light output surface 12 of the second lens 1B is configured with a plane surface. The light output surface 12 of the second lens 1B is positioned approaching to or in contact with the light input surface 11 of the first lens 1A. The light emitted from the point light source 2 is adapted to be inputted from the light input surface 11 of the second lens 1B and outputted form the light output surface 12 of the second lens 1B, and is then inputted from the light input surface 11 of the first lens 1A and then outputted from the light output surface 12 of the first lens 1A. In such a way, similar effect of eliminating the ghost image can also be achieved. According to an aspect of the embodiment, the second lens 1B can also be mixed with a fluorescent material of a certain color for obtaining a desired color combined light.

Figure 7:
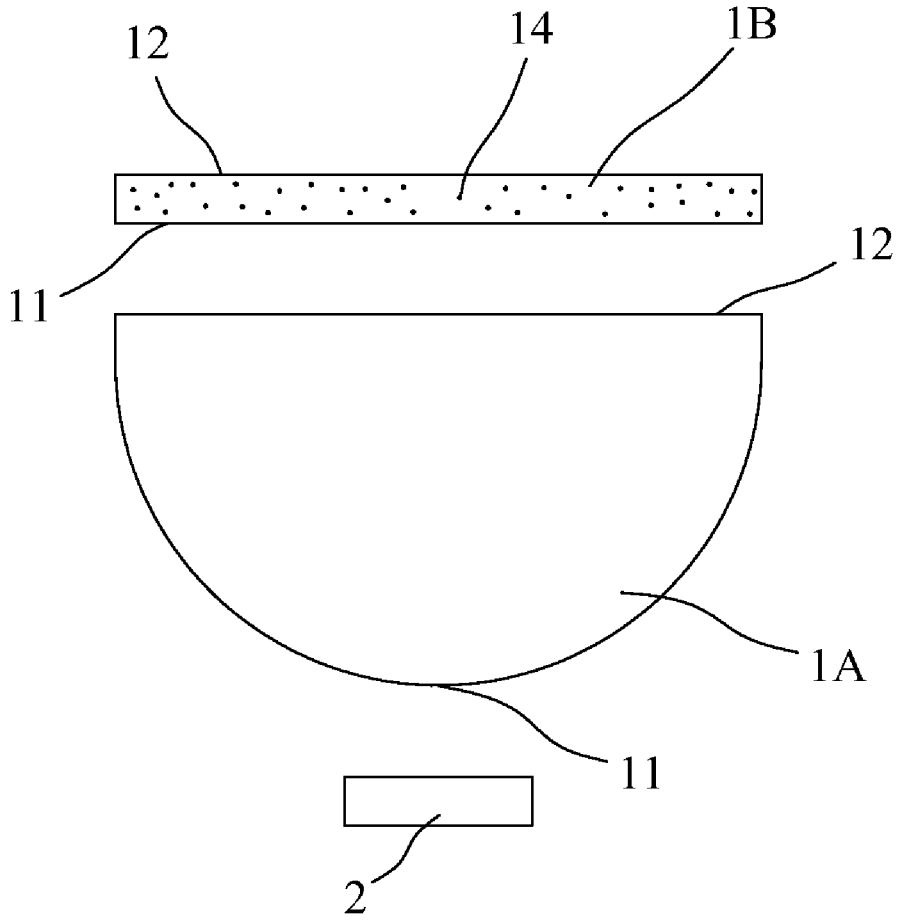
FIG. 7 is a schematic diagram illustrating two lenses employed serving as the medium elements according to another embodiment of the present invention.

FIG. 7 is a schematic diagram illustrating two lenses employed serving as the medium elements according to another embodiment of the present invention. Referring to FIG. 7, in this embodiment, there are also a first lens 1A and a second lens 1B employed for substituting the lens 1 and being provided for each of the point light sources 2. As shown in FIG. 7, the first lens 1A includes a light input surface 11 and a light output surface 1B, and the second lens 1B also includes a light input surface 11 and a light output surface 1B. The first lens 1A and the second lens 1B are collimated with the point light source 2. The light input surface 11 of the first lens 1A is configured with an arcuate surface, and the light output surface 12 of the first lens 1A is configured with a plane surface. The light input surface 11 of the second lens 1B is configured with a plane surface, and the light output surface 12 of the second lens 1B is configured with a plane surface. The light input surface 11 of the second lens 1B is positioned approaching to or in contact with the light output surface 12 of the first lens 1A. The light emitted from the point light source 2 is adapted to be inputted from the light input surface 11 of the first lens 1A and outputted form the light output surface 12 of the first lens 1A, and is then inputted from the light input surface 11 of the second lens 1B and then outputted from the light output surface 12 of the second lens 1B. In such a way, similar effect of eliminating the ghost image can also be achieved. According to an aspect of the embodiment, the second lens 1B can also be mixed with a fluorescent material of a certain color for obtaining a desired color combined light.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus adapted for eliminating a ghost image of point light sources, the apparatus comprising:

a plurality of point light sources adjacently arranged, each of the point light sources being adapted for emitting a light; and a plurality of medium elements provided corresponding to the point light sources, wherein each of the medium elements comprises a light input surface, and a light output surface, and both of the light input surface and the light output surface are arcuate surfaces adapted for diffusing the light emitted from the point light source;

wherein at least one of the light input surface and the light output surface is provided with an optical structure.

2. The apparatus according to claim 1, wherein the point light sources are light emitting diodes (LED).

3. The apparatus according to claim 1, wherein the medium elements are lenses.

4. The apparatus according to claim 3, wherein the lenses are hollow tube shaped, and each of the hollow tube shaped lenses has an inner surface serving as the light input surface and an outer surface serving as the light output surface.

5. The apparatus according to claim 3, wherein the lenses are column shaped, and each of the column shaped lenses comprises a longitudinal end surface serving as the light input surface, and an annular outer peripheral side surface serving as the light output surface.

6. The apparatus according to claim 5, wherein the column shaped lens is sheathed in a lampshade.

7. The apparatus according to claim 6, wherein the lampshade further comprises a fluorescent material doped therein so that a light outputted from the lampshade is a color combined light.

8. The apparatus according to claim 1, wherein at least one of the arcuate surfaces is a paraboloidal surface.

9. The apparatus according to claim 1, wherein at least one of the arcuate surfaces is a spherical surface.

10. The apparatus according to claim 1, wherein both the light input surface and the light output surface are provided with an optical structure.

11. The apparatus according to claim 1, wherein the optical structure comprises a plurality of fine protrusive dots.

12. The apparatus according to claim 1, wherein the optical structure comprises a plurality of fine recessive dots.

13. The apparatus according to claim 1, wherein the medium element comprises a fluorescent material doped therein so that a light outputted from the medium element is a color combined light.

14. An apparatus adapted for eliminating a ghost image of point light sources, the apparatus comprising:

a plurality of point light sources adjacently arranged, each of the point light sources being adapted for emitting a light; and a plurality of medium element pairs, provided corresponding to the point light sources, each of the medium element pairs comprising a first medium element and a second medium element;

wherein both the first medium element and the second medium element are lenses, the first medium element comprises a light input surface, and a light output surface, and the second medium element comprises a light input surface and a light output surface, wherein the light input surface of the first medium element is a plane surface, and the light output surface of the first medium element is an arcuate surface adapted for diffusing the light emitted from the point light source corresponding thereto, and both of the light input surface and the output surface of the second medium element are plane surfaces.

15. The apparatus according to claim 14, wherein the light input surface of the first medium element is positioned approaching to or in contact with the light output surface of the second medium element, and the light emitted from the point light source is inputted from the light input surface of the second medium element and outputted from the light output surface of the first medium element.

16. The apparatus according to claim 14, wherein the second medium element comprises a fluorescent material doped therein for obtaining a color combined light outputted from the light output surface of the first medium element.

17. An apparatus adapted for eliminating a ghost image of point light sources, the apparatus comprising:

a plurality of point light sources adjacently arranged, each of the point light sources being adapted for emitting a light; and a plurality of medium element pairs, provided corresponding to the point light sources, each of the medium element pairs comprising a first medium element and a second medium element, wherein the first medium element comprises a light input surface, and a light output surface, and the second medium element comprises a light input surface and a light output surface, wherein the light input surface of the first medium element is an arcuate surface adapted for diffusing the light emitted from the point light source corresponding thereto, and the light output surface of the first medium element is a plane surface, and both of the light input surface and the output surface of the second medium element are plane surfaces, wherein the light output surface of the first medium element is positioned approaching to or in contact with the light input surface of the second medium element, and the light emitted from the point light source is inputted from the light input surface of the first medium element and outputted from the light output surface of the second medium element.

18. The apparatus according to claim 17, wherein both of the first medium element and the second medium element are lenses.

19. The apparatus according to claim 17, wherein the second medium element comprises a fluorescent material doped therein for obtaining a color combined light outputted from the light output surface of the second medium element.

* * * * *